US010775110B2

(12) United States Patent
Snyder et al.

(10) Patent No.: US 10,775,110 B2
(45) Date of Patent: Sep. 15, 2020

(54) TIGHT TEMPERATURE CONTROL AT A THERMAL LOAD WITH A TWO PHASE PUMPED LOOP, OPTIONALLY AUGMENTED WITH A VAPOR COMPRESSION CYCLE

(71) Applicant: Rolls-Royce North American Technologies, Inc., Indianapolis, IN (US)

(72) Inventors: Douglas J. Snyder, Carmel, IN (US); Michael J. Head, Mooresville, IN (US)

(73) Assignee: ROLLS-ROYCE NORTH AMERICAN TECHNOLOGIES, INC., Indianapolis, IN (US)

( * ) Notice: Subject to any disclaimer, the term of this patent is extended or adjusted under 35 U.S.C. 154(b) by 0 days.

(21) Appl. No.: 16/058,222

(22) Filed: Aug. 8, 2018

(65) Prior Publication Data

US 2019/0316850 A1 Oct. 17, 2019

Related U.S. Application Data

(60) Provisional application No. 62/656,491, filed on Apr. 12, 2018.

(51) Int. Cl.

| | |
|---|---|
| ***F28D 15/06*** | (2006.01) |
| ***F25B 23/00*** | (2006.01) |
| ***F28D 15/02*** | (2006.01) |

(52) U.S. Cl.

CPC ..... *F28D 15/06* (2013.01); *F25B 23/006* (2013.01); *F28D 15/025* (2013.01); *F28D 15/0266* (2013.01)

(58) Field of Classification Search

CPC .. F25B 23/006; F28D 15/025; F28D 15/0266; F28D 15/06

See application file for complete search history.

(56) References Cited

U.S. PATENT DOCUMENTS 4,136,528 A * 1/1979 Vogel ..... F25B 41/04 62/174
4,484,452 A * 11/1984 Houser, Jr. ..... F25B 13/00 62/149

(Continued)

FOREIGN PATENT DOCUMENTS

EP 1610077 A2 12/2005
WO 2009039057 A1 3/2009

*Primary Examiner* — Tho V Duong
(74) *Attorney, Agent, or Firm* — Brinks Gilson & Lione

(57) ABSTRACT

A two-phase pump loop (TPPL) for dissipating a thermal load during operation of an apparatus includes a coolant, a vapor/liquid receiver, a pump, an evaporator, a condenser, a valve ($V_1$) configured to regulate a pressure at an outlet of the condenser; a valve ($V_2$) having a control set point set equivalent to a low pressure ($P_L$) measured in the vapor/liquid receiver; and a controller configured to control the set points of $V_1$ and $V_2$. The TPPL is configured to cool the thermal load with tight control of the temperature of the coolant that is cooling the apparatus. The TPPL may be combined with a vapor cycle system (VCS) to provide a thermal management system with the VCS being configured to use the same or different coolant than the TPPL.

5 Claims, 6 Drawing Sheets

(56) References Cited

U.S. PATENT DOCUMENTS

| | | | | | |
|---|---|---|---|---|---|
| 4,566,288 | A | * | 1/1986 | O'Neal | F25B 41/04 62/117 |
| 5,103,897 | A | | 4/1992 | Cullimore et al. | |
| 5,189,885 | A | * | 3/1993 | Ni | F25B 41/00 62/117 |
| 5,651,263 | A | * | 7/1997 | Nonaka | F25B 9/006 62/205 |
| 6,161,394 | A | * | 12/2000 | Alsenz | F25B 49/027 165/110 |
| 6,948,556 | B1 | | 9/2005 | Anderson et al. | |
| 2004/0237546 | A1 | | 12/2004 | Butsch | |
| 2011/0001013 | A1 | | 1/2011 | Torres et al. | |
| 2011/0056225 | A1 | | 3/2011 | Campbell et al. | |
| 2012/0324933 | A1 | | 12/2012 | Louvar et al. | |
| 2013/0074530 | A1 | | 3/2013 | Piesker et al. | |
| 2014/0137581 | A1 | | 5/2014 | Cho | |
| 2015/0135746 | A1 | | 5/2015 | Louvar | |
| 2016/0298883 | A1 | | 10/2016 | Louvar et al. | |

* cited by examiner

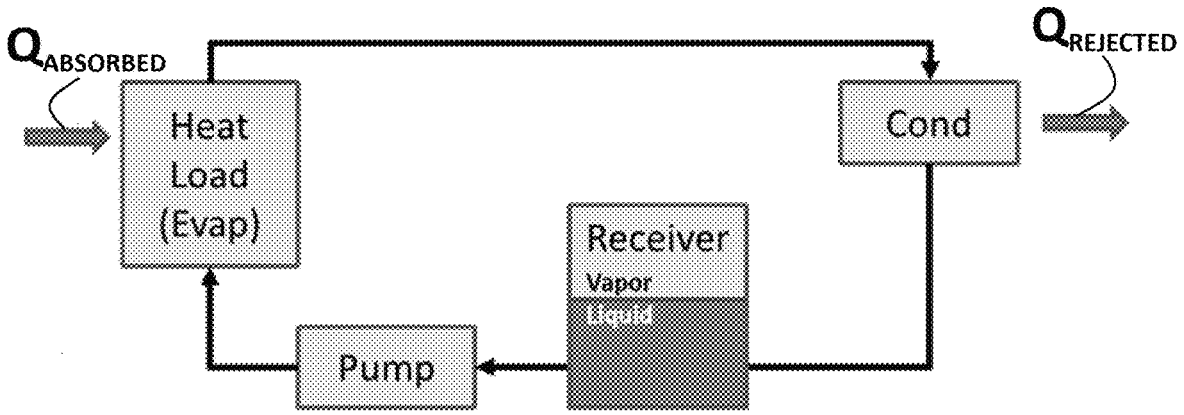
Figure 1
(Conventional)

TIGHT TEMPERATURE CONTROL AT A THERMAL LOAD WITH A TWO PHASE PUMPED LOOP, OPTIONALLY AUGMENTED WITH A VAPOR COMPRESSION CYCLE

CROSS-REFERENCE TO RELATED APPLICATIONS

This application claims priority to U.S. Provisional Application No. 62/656,491 filed Apr. 12, 2018, the entire content of which is incorporated herein by reference.

TECHNICAL FIELD

This disclosure relates generally to cooling systems.

BACKGROUND

The statements in this section merely provide background information related to the present disclosure and may not constitute prior art.

Conventional two-phase pump loops have been in existence since the 1980's as two-phase evaporative cooling units. One example of a conventional two-phase pump loop is provided in U.S. Pat. No. 6,948,556. However, the primary difference between the commercially available units and the two-phase pump loop (TPPL) of the present disclosure is the cooling temperature at the evaporator. An apparatus, such as a high-energy laser (HEL), needs to be maintained at a constant temperature regardless of ambient temperature. However, the commercially available units allow the evaporator temperature to change with ambient temperature.

DRAWINGS

In order that the disclosure may be well understood, there will now be described various forms thereof, given by way of example, reference being made to the accompanying drawings, in which:

FIG. 1 is a schematic representation of a conventional two-phase pump loop;

Figure 2A:
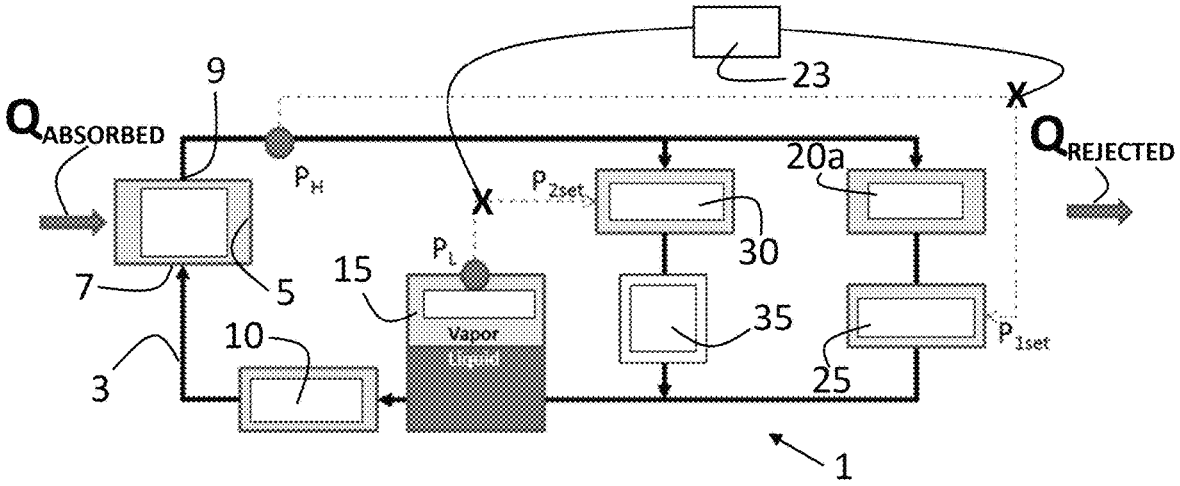
FIG. 2A is a schematic representation of a two-phase pump loop (TPPL) formed according to the teachings of the present disclosure.

The drawings described herein are for illustration purposes only and are not intended to limit the scope of the present disclosure in any way.

DETAILED DESCRIPTION

The present disclosure generally provides a two-phase pump loop (TPPL) for dissipating a thermal load during operation of an apparatus. One benefit of this TPPL is that the coolant passing through the device to be cooled remains essentially isothermal, because the coolant passes through the device as a two (2)-phase fluid (i.e., a vapor and liquid mixture). The temperature being the saturation temperature of the fluid based on the pressure of the fluid. In most cases, if the coolant pressure/temperature varies, this doesn't pose a problem. However, in some situations, the device to be cooled requires that the coolant temperature be held within a very tight tolerance, therefore precise control of the pressure is required for the two-phase fluid In some situations two independent heat loads operating at different temperatures is required and therefore would traditionally require two independent TPPL's to establish the different coolant temperatures and/or pressures. This approach requires a large amount of space and weight for the existence of redundant systems.

The following description is merely exemplary in nature and is in no way intended to limit the present disclosure or its application or uses. For example, the TPPL made and used according to the teachings contained herein is described throughout the present disclosure in conjunction with cooling a high-energy laser (HEL) in order to more fully illustrate the composition and the use thereof. The incorporation and use of such a TPPL in other industrial and military applications that may include any apparatus, device, or combination of apparatuses or devices that consume electricity and may benefit from cooling and/or heating are contemplated to be within the scope of the present disclosure. Several examples of such an apparatus or device includes, without limitation, solid state electronics, a light-emitting diode (LED), an analog circuit, a digital circuit, a computer, a server, a server farm, a data center, a hoteling circuit such as vehicle electronics, a vehicle, an aircraft, a directed-energy weapon, a laser, a plasma weapon, a railgun, a microwave generator, a pulse-powered device, a satellite uplink, an electric motor generator, an electric device, or the like.

For the purpose of this disclosure, the terms "valve", "expansion valve", "pressure reducing valve", and "back pressure regulator" or "BPR" may be used interchangeably in the description of a component in the two-phase pump loop (TPPL) and are intended to provide substantially similar or the same performance. The term "valves" is intended to indicate a plurality of valves in which each valve is independently selected to be an expansion valve, pressure reducing valve, or a back pressure regulator.

For the purpose of this disclosure, the terms "about" and "substantially" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one source", "one or more sources", and "source(s)" may be used interchangeably and are intended to have the same meaning.

For the purpose of this disclosure, the term "tight" temperature control describes controlling a temperature condition with minimal variation, such as ±5° C.; alternatively, ±3° C.; alternatively, ±1° C.; alternatively, ±0.5° C. When desirable, this control over the variation in temperature may also be expressed as a percentage of the measured temperature. For example, as the measured temperature is controlled to be within ±10%; alternatively, ±5%; alternatively, ±3%; alternatively, ±1%.

For purposes of promoting an understanding of the principles of the present disclosure, reference will now be made to various embodiments illustrated in the drawings, and specific language will be used to describe the same. It should be understood that throughout the description, corresponding reference numerals indicate like or corresponding parts and features. One skilled in the art will further understand that any properties reported herein represent properties that are routinely measured and may be obtained by multiple different methods. The methods described herein represent one such method and other methods may be utilized without exceeding the scope of the present disclosure.

No limitation of the scope of the present disclosure is intended by the illustration and description of certain embodiments herein. In addition, any alterations and/or modifications of the illustrated and/or described embodiment(s) are contemplated as being within the scope of the present disclosure. Further, any other applications of the principles of the present disclosure, as illustrated and/or described herein, as would normally occur to one skilled in the art to which the disclosure pertains, are contemplated as being within the scope thereof.

Referring to FIG. 1, the challenge for maintaining the temperature/pressure in a closed two-phase pump loop system. The system receives heat in the evaporator on the left and rejects the heat from a condenser on the right. In this conventional two-phase pump loop, the pressure of the system will vary depending on heat loads. One can choose to design the system to have the proper coolant mass/charge, such that at peak heat load and steady state operation, the fluid entering the heat load is at the proper pressure and temperature. However, if the heat load were to be suddenly reduced, the condenser will for a while reject more heat than the evaporator is receiving from the heat load. In this condition, the overall system temperature/pressure will begin to fall. This will result in the liquid in the receiver getting colder. If the heat added and removed aren't balanced, the temperature and pressure in the loop will change and therefore, the temperature of the coolant entering the evaporator will not meet the narrow temperature requirement. A heat load imbalance is expected to occur due to heat loads that are highly transient. One could vary the amount of heat removed from the condenser; however, most control schemes are expected to be relatively slow in responding relative to the rate of change in the load in the evaporator.

The features associated with the concept of the present disclosure lie in the controls used to maintain the temperature of the coolant entering the load evaporator to a tight temperature window, by controlling the vapor/liquid receiver pressure and evaporator exit pressure. An additional feature is the optional integration of one or more Vapor Cycle Systems (VCS) with the TPPL. A primary VCS has control features to quickly restore high cooling capacity after the VCS has been placed in a low power consumption status. A secondary VCS has the ability to provide cooling at a different temperature/pressure and manage low power loads. In addition, concepts are provided within the present disclosure that minimize the electrical power consumption required to run the system.

Referring now to FIG. 2A, one proposed embodiment for a TPPL 1 designed according to the teachings of the present disclosure is provided. This concept assumes that there is some heat sink for the condenser 20*a* to reject heat that is sufficiently cold and the fluid in the evaporator 5 doesn't become too hot. This concept uses two valves ($V_1$, $V_2$) 25, 30, e.g., electronic expansion valves or back pressure regulators, to manage temperature to the load evaporator 5. The $V_1$ 25 is designed to limit the maximum pressure at the upstream side of the device. If the pressure is below the set point ($P_{1set}$) pressure, the $V_1$ 25 blocks flow. As the pressure rises above the set point, the $V_1$ 25 begins to pass flow so that the pressure does not rise above the set point.

One skilled in the art will understand that $V_1$ 25 may be located after the condenser 20*a* as shown in FIG. 2A, or if enhanced temperature control is desired, the $V_1$ 25 may be located prior to the condenser 20*a* without exceeding the scope of the present disclosure. In addition, although back pressure regulators are described throughout the present disclosure, one skilled in the art will understand that the substitution of the back pressure regulators with other types of pressure reducing valves are contemplated to be within the scope of the present disclosure.

In this disclosure, when a thermal storage material is not present (i.e., a phase change material or a highly chilled coolant), it is assumed that the maximum heat ($Q_{REJECTED}$) rejection capacity at the condenser 20*a* is always greater than or equal to the heat ($Q_{ABSORBED}$) being absorbed in the evaporator 5, when averaged over a short time period. One skilled in the art will understand that if a large heat load is absorbed in the evaporator at a specific time, then $Q_{ABSORBED}$ may be temporarily greater than $Q_{REJECTED}$ at that specific time. In this design, the $V_1$ 25 has a pressure set point ($P_{1set}$) such that the pressure at or after the exit of the load evaporator 5 is the saturation pressure ($P_H$) that is required to give the proper coolant temperature in the load evaporator 5. In other words, $P_{1set}$ is set to achieve an evaporator exit pressure that is the saturation pressure ($P_H$) of the coolant 3 at a predetermined or desired target exit temperature from the evaporator 5. The set point pressure ($P_{1set}$) is expected to be slightly lower than the saturation pressure ($P_H$) due to expected pressure losses in the line from the load evaporator to the $V_1$ 25 device. However, $V_1$ 25 will not prevent the coolant 3 in the vapor/liquid receiver 15 from getting colder than the temperature that is required at the inlet to the load evaporator 5. As a result, a second valve ($V_2$) 30 is also added to the TPPL 1 described herein.

The $V_2$ 30 manages how much heat $Q_{REJECTED}$ is actually pulled from the TPPL system 1. A flow restriction 35 may be present at or near the outlet of $V_2$ 30, upstream of $V_2$ 30, or anywhere along the flow pathway associated with $V_2$ 30. Reducing the coolant 3 flow to the condenser 20*a* reduces $Q_{REJECTED}$ and returns heat to the vapor/liquid receiver 15. This will prevent the vapor/liquid receiver 15 from becoming excessively cold and thus keeps the fluid going to the load evaporator 5 at an acceptable temperature. When desirable, the condenser 20*a* may be cooled with a cold water-fluid mixture (e.g., water-polypropylene glycol mixture, etc.) from a previously chilled tank of liquid or it could be cooled with a cold air stream.

Still referring to FIG. 2A, the two-phase pump loop (TPPL) 1 generally comprises, consists of, or consists essentially of a vapor/liquid receiver 15 configured to store a coolant 3; a pump 10 configured to force the coolant 3 to flow through lines or tubes throughout the TPPL 1; an evaporator 5 configured to absorb heat ($Q_{ABSORBED}$) from the apparatus, the evaporator 5 comprising an inlet 7 and an outlet 9; a condenser 20*a* configured to release heat ($Q_{REJECTED}$) in order to remove the heat ($Q_{REJECTED}$) from the TPPL 1; and a valve ($V_1$) 25 configured to regulate a pressure at an outlet of the condenser 20*a*, the $V_1$ 25 having a control set point at a first pressure ($P_{1set}$); a valve ($V_2$) 30 having a control set point set at a second pressure ($P_{2set}$); and a controller configured to control the set points of $V_1$ and $V_2$.

The controller 23 is configured to set $P_{1set}$ so as to provide a predetermined pressure at the outlet of the evaporator 5 that is the saturation pressure at the desired operating temperature of evaporator 5 and the controller 23 is configured to vary $P_{2set}$ so as to maintain the pressure in the vapor/liquid receiver 15 at $P_L$. The $P_{2set}$ is set to prevent the vapor/liquid receiver pressure from going to a pressure/temperature that is lower than a predetermined value. The $P_{1set}$ is less than saturation pressure ($P_H$) of the coolant 3 at the outlet 9 of the evaporator 5; while the $P_{2set}$ is used to keep low pressure ($P_L$) within an acceptable pressure range. In other words, the controller 23 defines values for $P_{1set}$ and $P_{2set}$, such that the $P_H$ and $P_L$ are achievable within an established or predetermined tolerance.

The controller 23 may be any device that performs logic operations. The controller 23 may be in communication with a memory (not shown). Alternatively or in addition, the controller 23 may be in communication with multiple components within the TPPL 1. The controller 23 may include a general processor, a central processing unit, a server device, an application specific integrated circuit (ASIC), a digital signal processor, a field programmable gate array (FPGA), a digital circuit, an analog circuit, a microcontroller, any other type of processor, or any combination thereof. The controller 23 may include one or more elements operable to execute computer executable instructions or computer code embodied in the memory.

The memory may be any device for storing and retrieving data or any combination thereof. The memory may include non-volatile and/or volatile memory, such as a random access memory (RAM), a read-only memory (ROM), an erasable programmable read-only memory (EPROM), or flash memory. Alternatively or in addition, the memory may include an optical, magnetic (hard-drive) or any other form of data storage device.

In general, the TPPL 1 is configured to cool the thermal load with tight control of the temperature of the coolant 3 that is cooling the apparatus. The control set point of $V_2$ 25 is varied to balance the heat ($Q_{REJECTED}$) removed from coolant 3 at the condenser 20*a* with the heat ($Q_{ABSORBED}$) absorbed by the coolant 3 at the evaporator 5. For the purpose of this disclosure, the phrase "to balance the heat ($Q_{REJECTED}$) with the heat ($Q_{ABSORBED}$)" refers to the heat ($Q_{REJECTED}$) being equal to the sum of the heat ($Q_{ABSORBED}$) plus any other heat additions or losses encountered during the operation of the system. These other heat additions or losses may occur, without limitation, through the operation of compressors, pumps, and other system components. This balance is achieved by reducing the amount of coolant 3 that gets passed through the condenser 20*a*. The $Q_{REJECTED}$ released from the coolant 3 at the condenser 20*a* is at least equal to the $Q_{ABSORBED}$ absorbed by the coolant 3 at the evaporator 5. In other words, $V_1$ 25 is used to set the exit pressure of the load 5. $V_2$ 30 is used to control the pressure in the vapour/liquid receiver 15. It is assumed that the maximum cooling capacity of the condenser 20*a* is always greater than the heat entering the evaporator 5 over a short period of time. However, the condenser 20*a* should not remove more heat than is being put into the system at the load evaporator 5. Therefore, when desirable or necessary the cooling performed at the condenser 20*a* may be reduced. This reduction is achieved by not sending all of the coolant 3 to the condenser 20*a* by lowering the $P_{2set}$ so that some of the coolant 3 is passed through $V_2$ 30. In the extreme, if no heat is being added to the evaporator 5, almost all of the coolant 3 would be passed through $V_2$ 30. In this way, the pressure and/or temperature in the vapor/liquid receiver 15 is managed so that the receiver 15 is not overcooled. This will assure that the temperature of the coolant 3 entering load evaporator 5 doesn't get too cold The coolant 3 in the TPPL 5 may be any substance suitable for use in a two-phase pump loop (TPPL) 5. In other words, the coolant 3 may be any substance suitable for use in a refrigeration system or that experiences a phase change. Several examples of a coolant 3 may include, without limitation, a chlorofluorocarbon (CFC), a hydrochlorofluorocarbon (HCFC), a hydrofluorocarbon (HFC), difluoromethane, difluoroethane, ammonia, water/ammonia mixture, or a combination thereof.

The outlet of the vapor-liquid receiver 15 includes a means of creating a pressure rise. More specifically, a pump 10 is located approximate to the exit of the vapor/liquid receiver 15 in order to create flow of the coolant 3 to the load evaporator 5. The pump 10 should draw liquid coolant 3 from the vapor/liquid receiver 15.

The vapor-liquid receiver 15 may include any device configured to separate a vapor-liquid mixture into vapor and liquid portions. The vapor-liquid receiver 15 may be a vessel in which gravity causes the liquid portion to settle to a bottom portion of the vessel and the vapor portion to rise to a top portion of the vessel.

One skilled in the art will understand that the evaporator 5 used in conjunction with the TPPL 1 may be made smaller by selecting appropriate heat exchanger core designs for its construction without exceeding the scope of the present disclosure. More specifically, the important features of this evaporator 5 include the ability to transfer heat, the evacuation of any evaporated liquid, and the containment of pressure. A diffusion-bonded structure, such as applied to the design and construction of turbine airfoils may be used to form the evaporator 5. A diffusion-bonded structure includes complex heat transfer and fluid flow passages. The rules, tools, and manufacturing techniques employed in designing actively cooled turbines directly applies to the problem of providing for the cooling of an apparatus—with the addition of two-phase heat transfer and pressure drop calculations.

Figure 2B:
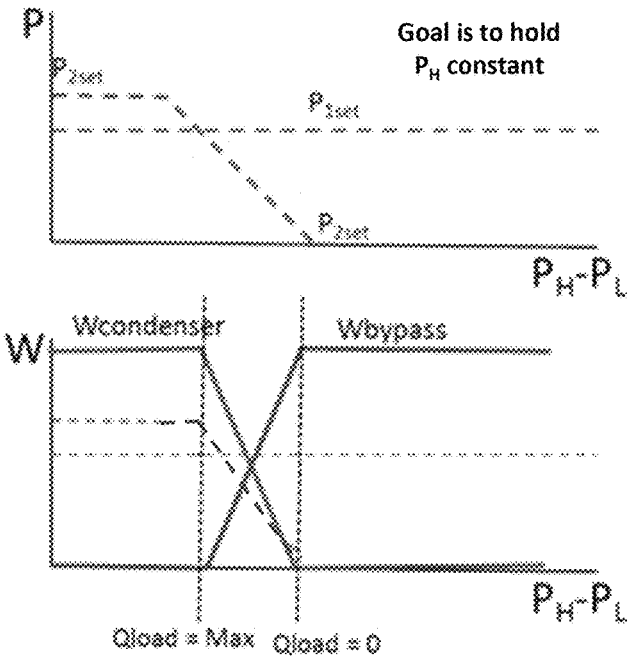
FIG. 2B is a plot of a control scheme for the set points ($P_{1set}$, $P_{2set}$) set for valves ($V_1$, $V_2$) in the TPPL of FIG. 2A.

Referring now to FIGS. 2A and 2B, in the case when the heat load at the evaporator 5 suddenly decreases, the fluid exiting $V_1$ 25 will be over-cooled. This will result in the receiver becoming colder, but also in the pressure in the vapor/liquid receiver 15 beginning to fall. As the pressure begins to fall, the $V_2$ 30 will have its set point ($P_{2set}$) reduced to begin to allow two-phase flow to pass through it. As a result, the flow rate through the condenser 20*a* will be reduced and the amount of heat ($Q_{REJECTED}$) being removed from the condenser 20*a* will decrease. Furthermore, the fluid passing through $V_2$ 30 will have some of the heat from the evaporator 5 and as a result, will begin to increase the temperature of the vapor/liquid receiver 15 and begin to restore the temperature closer to the target temperature of coolant 3.

The TPPL 1 as shown in FIGS. 2A and 2B may be built with existing commercial off-the-shelf valves, e.g., back pressure regulators. The valves are very good at maintaining an upstream pressure, even as the fluid passing through it can vary in quality (e.g., ratio of vapor flow to total mass flow). Furthermore, the design can have the pressure set point $P_{2set}$ changed very quickly, i.e., on the order of about 100 milliseconds. Therefore, a controller 23 can determine the proper pressure set point for $V_2$ 25 as a function of the pressure in the vapor/liquid receiver 15. As the pressure in the vapor/liquid receiver 15 falls, the $V_2$ 30 set point can be lowered below $V_1$ 25 to begin to pass more of the fluid through $V_2$ 30. A small downstream or upstream flow restriction 35 may be necessary to help with stability of the system.

The controller 23 sets $V_1$ 25 at a set point ($P_{1set}$) to provide the desired temperature at the exit of the evaporator 5. The $P_{1set}$ may not match the evaporator 5 exit pressure ($P_H$) due to pressure losses. The pressure ($P_L$) in the vapor/liquid receiver 15 is monitored to determine if the receiver 15 is getting too cold. The $P_{2set}$ is varied to maintain $P_L$. As $P_L$ decreases due to excess cooling at $Q_{REJECTED}$, more flow passes through $V_2$ 30 and therefore, $Q_{REJECTED}$ is lowered. Thus, the two valves, $V_1$ 25 and $V_2$ 30, balance the heat $Q_{REJECTED}$ removed from the coolant 3 at the condenser 20*a* with the heat $Q_{ABSORBED}$ absorbed by the coolant 3 at the evaporator 5 plus any other heat additions or losses encountered during the operation of the system.

An alternative design may be to use a pressure reducing valve in place of a back pressure regulator at $V_2$ 30. In this case, the pressure reducing valve will remain closed until the pressure in the vapor/liquid receiver 15 falls below a set value, which may reduce the need to actively control the set point pressure in the $V_2$ 30 location. Other types of valves could also be considered based on their ability to control flow rates in order to control pressure of the vapor/liquid receiver 15 and evaporator exit 9.

Figure 3:
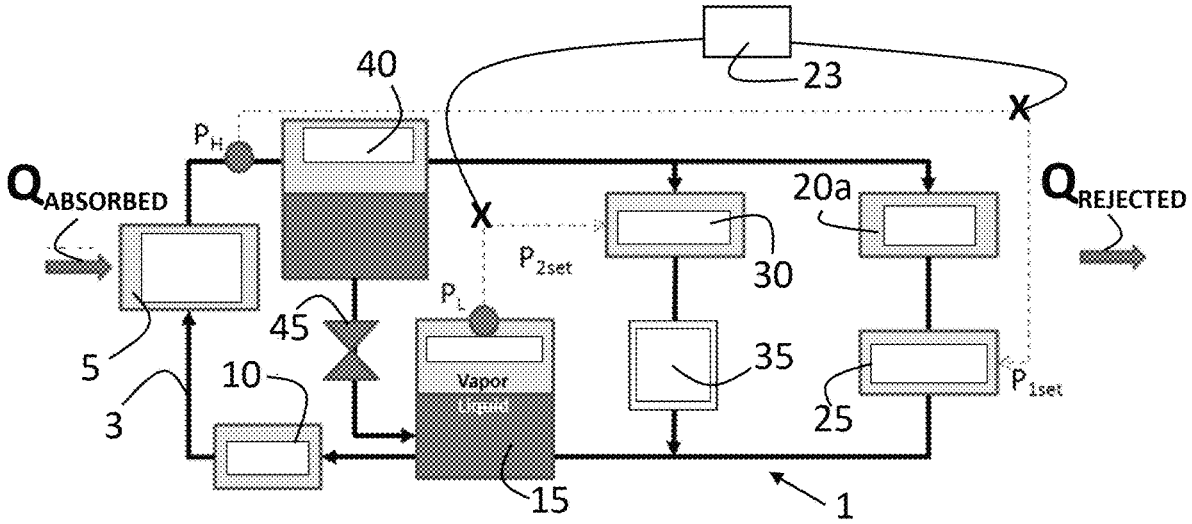
FIG. 3 is a schematic representation of another two-phase pump loop (TPPL) formed according to the teachings of the present disclosure.

Referring now to FIG. 3, the TPPL 1 may be modified to minimize challenges associated with two-phase flow. In this TPPL 1 design, the fluid that exits from the load evaporator has the liquid and vapor separated. A liquid separator 40 is placed downstream of the load evaporator 5 and is in fluid communication with the outlet of evaporator 5. This will provide a more uniform quality to the flow of coolant 3 to $V_2$ 30. This flow of coolant 3 to $V_2$ 30 need not be pure vapor, but a very high quality of flow will enable a more consistent mass flow rate through $V_2$ 30 for a given valve opening and pressure difference across the valve. This would enable the use of a wider variety of valves to replace $V_2$ 30. It is not critical that all the liquid be separated, but only a significant portion.

Still referring to FIG. 3, the liquid separator 40 is configured to return all or a portion of the separated liquid coolant 3 through a liquid return valve 45 to the vapor/liquid receiver 15. Alternatively, about 99% to 100% of the liquid coolant 3 is returned. The pressure difference between the tanks will drive the liquid flow. A sensor could be used to measure the level of liquid in the separator in order to control the flow through the liquid return valve and then use the liquid control valve 45 to manage the height of that liquid. When desirable, $V_2$ 30 could be replaced with a pressure-reducing valve without exceeding the scope of the present disclosure when the flow of the coolant 3 to $V_2$ 30 is nearly all vapor and the pressure-reducing valve doesn't exhibit too large of a variation in pressure drop versus flow rate.

When desirable, the liquid separator 40 may use centrifugal force to drive the liquid portion towards an outer edge of the vessel for removal and the vapor portion may migrate towards a center region of the vessel. In some examples, the liquid separator 40 may include a level sensor mechanism that monitors a level of the liquid in the vessel.

Figure 4:
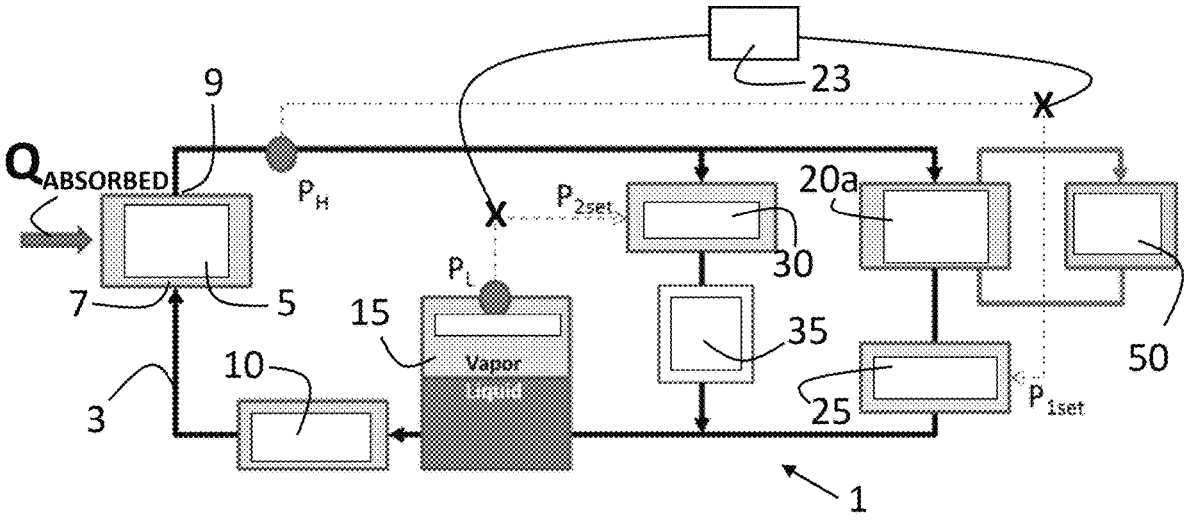
FIG. 4 is a schematic representation of the TPPL of FIG. 3 integrated with a refrigeration system according to the teachings of the present disclosure.

Referring now to FIG. 4, an embodiment is presented that includes the use of a refrigeration system that provides cooling in the condenser 20*a* of the TPPL 1 to ensure a sufficiently cold heat sink on days when ambient conditions are higher than the required temperature that is entering the load evaporator 5. For example, the TPPL 1 may be integrated with a vapor cycle system (VCS) 50 in which the VCS 50 is configured to remove heat from the TPPL 1 when the temperature of the coolant 3 flowing through the inlet of the evaporator 5 is about ambient temperature or substantially less than ambient temperature. In this case, the term "about" ambient temperature includes an evaporator inlet temperature that is slightly greater than ambient temperature; alternatively, ±5° C. of ambient temperature; alternatively, ±2.5° C.; alternatively, ±1° C.; alternatively, ±0.5° C.

In this embodiment, the TPPL 1 behaves the same as the prior embodiment shown in FIGS. 2A and 3. A challenge in this system is how to manage the condition when the heat load in the load evaporator becomes very low. In this case, when the heat load on the VCS 50 becomes very low, it may be difficult to have the VCS 50 at low cooling capacities and to then to rapidly provide high levels of cooling. Options for quickly recovering high cooling capacity after operating at lower heat loads include the incorporation of one of a hot gas bypass loop or reducing the pressure drop across an expansion valve into the VCS 50.

Figure 5A:
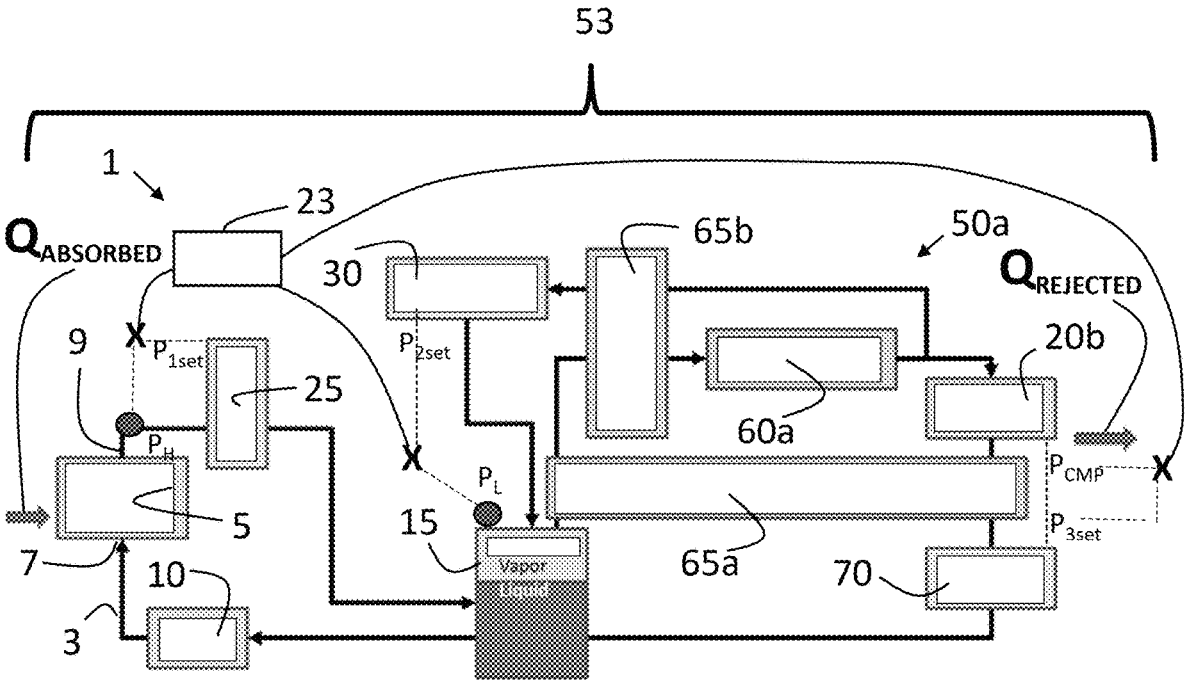
FIG. 5A is a schematic representation of a thermal management system comprising a TPPL and a VCS that utilize the same coolant.

Referring now to FIG. 5A, the TPPL 1 may be incorporated into a thermal management system 53 in order to dissipate a thermal load during operation of an apparatus. The thermal management system 53 may comprise the two-phase pump loop (TPPL) 1 as previously described and further defined herein, and a primary vapor cycle system (p-VCS) 50*a* that are configured to use the same coolant 3 and to be in fluid communication through a vapor/liquid receiver 15.

This design eliminates the need for the condenser/evaporator component in FIG. 4, addresses low load operational concerns, and reduces the overall system weight and size. In this configuration, a third valve $V_3$ 70 is added to function as an expansion valve in the VCS 50A. The set point ($P_{3set}$) of $V_3$ 70 is set to maintain a predetermined pressure at an exit of the compressor 60*a*. The $V_3$ 70 set point ($P_{3set}$) pressure is increased in order to allow the compressor 60*a* to increase the coolant 3 pressure and therefore temperature, to be able to reject heat from the condenser 20*b* to the available heat sink (e.g. air) and therefore to provide cooling to the coolant 3.

Again, it is important to maintain the vapor/liquid receiver 15 pressure and temperature to satisfy the inlet temperature requirement to the load evaporator 5. In this case, a line passes from the compressor 60*a* exit to the vapor/liquid receiver 15. If the pressure begins to fall in the vapor/liquid receiver 15, the $V_2$ 30 set point pressure may be reduced to be less than the $V_3$ 70 set point pressure. In so doing, less coolant 3 is passed through condenser 20*b* and overcooling of the vapor/liquid receiver 15 is avoided. It is possible that $V_3$ 70 and $V_2$ 30 could also use conventional electronically controlled expansion valves.

Typically, a coarse cooling capacity adjustment may be achieved by slowing the compressor 20*b* and the fans for condenser air heat sink. However, using these approaches may prevent the VCS 50*a* from rapidly ramping up to provide sufficient cooling capacity in the event of a sudden load increase. In the architecture shown in FIG. 5A, the pressure set points for $V_2$ 30 and $V_3$ 70 may be varied to manage cooling capacity. Assuming initially that $P_{2set}>P_{3set}$, the set point pressure on $V_3$ 70 may be reduced to lower the power consumption in the compressor 20*b* and the cooling provided from the VCS 50*a*. If the volume between the compressor 60*a* and the valves $V_3$, $V_2$ is sufficiently small, the cooling capacity of the VCS 50*a* can be rapidly restored by increasing the $V_3$ set point pressure ($P_{3set}$).

In order to control the pressure and/or temperature in the vapor/liquid receiver 15 and further reduce cooling from condenser 20*b*, the pressure set point in $V_2$ 30 may be varied to be slightly below the set point of $V_3$ 70. This will result in less coolant 3 being cooled as it is passing through the condenser 20*b*. Also shown in FIG. 5A are recuperators 65*a*. 65*b* for superheat management of the flow entering the compressor 20*b*. The fluid exiting the vapor/liquid receiver 15 and flowing to the compressor 20*b* will be at saturated conditions and may also have some entrained liquid. The recuperators 65*a*, 65*b* would add heat and avoid passing liquid to the compressor 20*b*. On the $V_2$ 30 leg, during a turn-down operation, a more conventional expansion valve could be used.

Still referring to FIG. 5A, the TPPL 1 generally comprises: the vapor/liquid receiver 15 configured to store the coolant 3; a pump 10 configured to force the coolant 3 to flow through lines or tubes throughout the TPPL 1; an evaporator 5 having an inlet 7 and an outlet 9 that is configured to absorb heat ($Q_{ABSORBED}$) from the apparatus; a valve ($V_1$) 25 having a control set point set at a first pressure ($P_{1set}$) to establish the proper pressure at $P_H$ measured at the outlet 9 of the evaporator 5, the $P_{1set}$ being less than a saturation pressure ($P_H$) of the coolant 3

Still referring to FIG. 5A, the p-VCS 50A generally comprises: the vapor/liquid receiver 15 configured to store the coolant 3; a condenser 20*b* configured so that the coolant 3 releases heat ($Q_{REJECTED}$) in order to remove heat ($Q_{REJECTED}$) from the thermal management system 53; a valve ($V_2$) 30 having a control set point set at a second pressure ($P_{2set}$), the $P_{2set}$ being set higher or lower than $P_{3set}$ to control the amount of flow through condenser 20*b*; a compressor 60*a*; a valve ($V_3$) 70 configured to act as an expansion valve; the $V_3$ 70 having a control set point ($P_{3set}$) set to maintain a predetermined pressure ($P_{CMP}$) at the outlet of the compressor 20*b*; one or more recuperators 65*a*, 65*b* configured with condenser exit flow or hot bypass flow to prevent any coolant 3 in liquid form from entering the compressor 60*a*; and a controller 23 configured to control the set points of $V_1$, $V_2$, and $V_3$. The controller 23 is configured to set $P_{1set}$ in order to provide a predetermined temperature at the outlet of the evaporator 5 and the controller 23 is configured to vary $P_{2set}$ and $P_{3set}$ in order to maintain the proper amount of cooling in order to maintain the pressure in the vapor/liquid receiver 15 at $P_L$. The $V_2$ is configured to allow a portion of the coolant 3 exiting the compressor 60*a* to flow back into the vapor/liquid receiver 15 in order to prevent overcooling of the vapor/liquid receiver while allowing the compressor to continue to run.

The control set points of $V_2$ and $V_3$ are variable in order to balance the heat ($Q_{REJECTED}$) removed from the coolant 3 at the condenser with the heat ($Q_{ABSORBED}$) absorbed by the coolant 3 at the evaporator. More specifically, the heat ($Q_{REJECTED}$) is equal to the sum of the heat ($Q_{ABSORBED}$) plus any other heat additions or losses encountered during the operation of the system. These other heat additions or losses may occur, without limitation, through the operation of compressors, pumps, and other system components. One skilled in the art will understand that sensors may be utilized to measure and monitor the pressure and/or temperature at or near the outlet of the evaporator and in the vapor/liquid receiver without exceeding the scope of the present disclosure. FIG. 5A provides a system with greater operability, and reduces the overall system size and weight since the VCS 50A has the same working fluid as the TPPL 1.

Figure 5B:
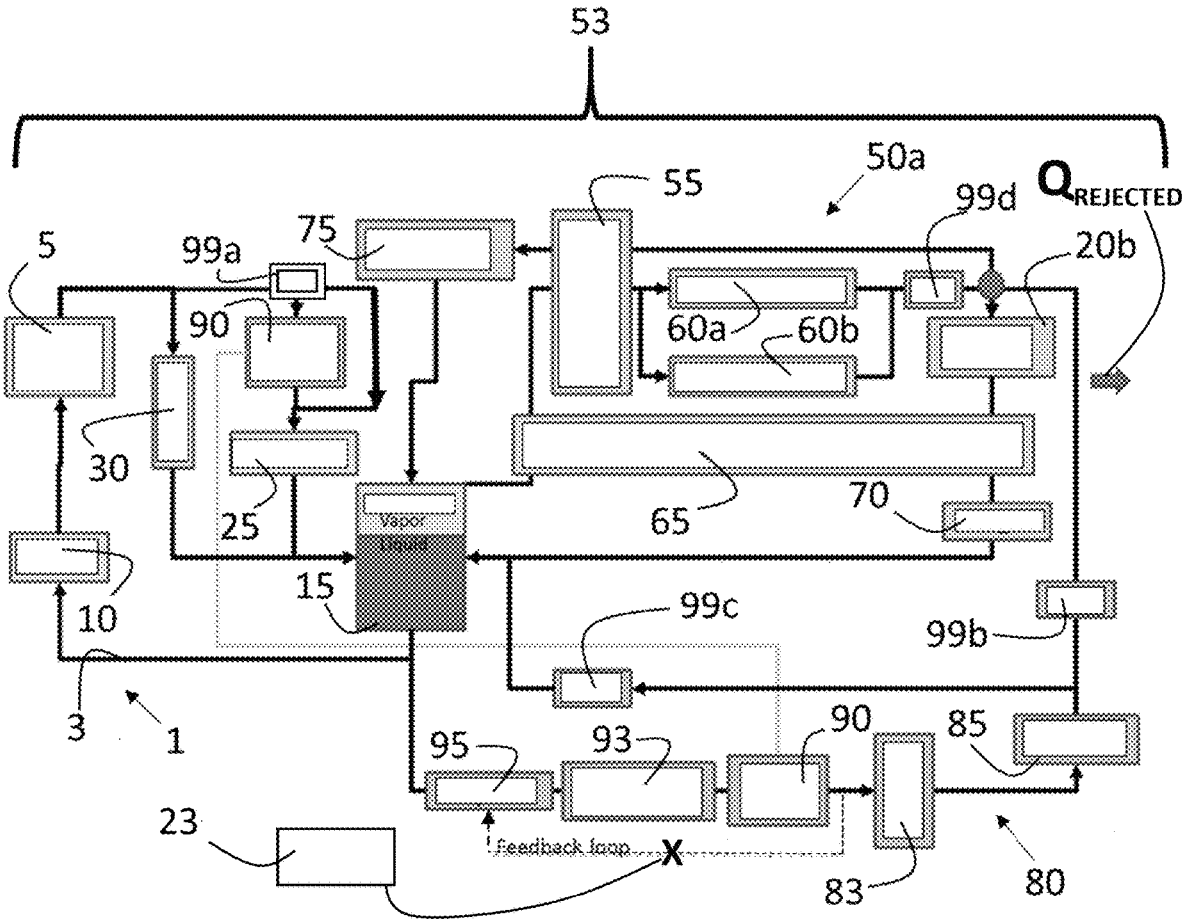
FIG. 5B is a schematic representation of another thermal management system comprising a TPPL and VCS that provides additional low temperature cooling.

Referring now to FIG. 5B another concept is illustrated for providing additional cooling for a low power and/or lower temperature heat load 93. In this case, the p-VCS 50*a* may comprise a second compressor 60*b* located parallel to the compressor 60*a* in order to minimize power draw. This lower power, lower temperature cooling may also be achieved by incorporating a secondary vapor cycle system (s-VCS) 80. The original, high power VCS is called the primary vapor cycle system (p-VCS) 50*a*.

The s-VCS 80 generally comprises a phase change material (PCM) located in an evaporator/condenser (PCM/Ev/Cnd) 90, the PCM providing thermal energy storage by absorbing heat until the p-VSC 50*a* is operational; an accumulator 83; a third compressor 85 configured to force a portion of the coolant 3 to flow to the vapor/liquid receiver 15; and a plurality of valves 99A-99D; wherein at least one valve 99A is configured to manage the use of the PCM/Ev/Cnd 90 and the other valves 99B-99D are configured to allow the s-VCS 80 to share the use of the condenser 20*b* located in the p-VCS 50*a* or to allow a portion of the coolant 3 to flow to the vapor/liquid receiver 15.

The PCM may be used when the heat load $Q_{ABSORBED}$ is greater than the heat rejection capacity of the system at a given point in time. This could be the case when no compressors are running or only the secondary s-VCS 80 is operational. The plurality of valves 99A-99D are used when the third compressor 85 is operating to either send coolant 3 to the vapor/liquid receiver 15 when the p-VCS 50*a* is operational or to send the coolant 3 to the condenser 20*b*, and then on to the receiver 15 when the p-VCS 50*a* is not operating.

The s-VCS 80 may also comprise an expansion valve 95 that is in fluid communication with the outlet of the vapor/liquid receiver 15. This expansion valve 95 is to pass liquid coolant 3. A feedback loop established between the outlet of the PCM/Ev/Cnd 90 and the expansion valve 95 is configured to maintain a superheat condition at the inlet of compressor 85. The controller 23 may be used to control the expansion valve such that only vapor enters the third compressor.

The compressors 60*a*, 60*b*, 85 may be any mechanical device that increases a pressure of a gas by reducing the volume of the gas. The compressors may be used in conjunction with an oil receiver when desirable. Examples of a compressor 60*a*, 60*b*, 85 may include but not be limited to any gas compressor, such as a positive displacement compressor, a dynamic compressor, a rotary compressor, a reciprocating compressor, a centrifugal compressor, an axial compressor, and/or any combination thereof.

The thermal management system 53 described in FIG. 5B provides thermal energy storage and the ability to more quickly bring high cooling capability on-line. The secondary VCS 80 expands liquid contained in the vapor/liquid receiver 15. The expanded coolant 3 cools the low temperature heat load 93 and also provides cooling to the load evaporator 5 when that heat load is very small or the primary VCS 50*a* is not operational. When there is a thermal load that requires cooling at a lower temperature than $Q_{ABSORBED}$, and $Q_{ABSORBED}$ is sufficiently small, the secondary VCS may be used. In this low load condition, valve 99A bypasses the phase change material (PCM). The PCM/Ev/Cnd component 90 is cooled to a temperature below the exit temperature of the load evaporator 5 (by fluid that is expanded by the expansion valve 95) and the phase change material (PCM) is typically operating in the solid state in order to be ready to absorb a large heat load from evaporator 5, should it occur. If the load evaporator 5 suddenly has a very high heat load, valve 99A routes coolant 3 through the PCM and the PCM/Ev/Cnd 90 absorbs this heat until the primary VCS system 50*a* can come on-line. Once the primary VCS 50*a* begins to chill, a valve 99*a* switches in order to bypass the PCM/Ev/Cnd 90. This allows any un-melted PCM to remain in solid form and to allow the melted PCM to be refrozen by fluid passing through expansion valve 95.

The PCM/Ev/Cnd 90 can also allow periods for the compressor 60*a*, 60*b*, 85 to be shut-off in order to avoid operation under very poor efficiency conditions. The PCM/Ev/Cnd 90 can condense the vapor from the load evaporator 5 during this time period. If the melt temperature is suitably chosen, it may also extend the period of time that the coolant 3 can be expanded for cooling the low temperature heat load 93 while compressor 85 is turned off and thereby allow a smaller accumulator 83 or extend the period of time that compressor 20*b* can be turned off. During this period, with the compressor turned off, the vapor exiting the low temperature heat load 93, would be condensed in the PCM/Ev/Cnd 90. For this to work, the lower temperature low heat load 93 would need to be able to have its operating temperature rise above the melting point of the PCM.

One skilled in the art will understand that the temperature requirement for the low temperature heat load 93 is a range of temperatures. The melt temperature of the PCM in the PCM/Ev/Cnd 90 could be set between the high and low temperature limit 93. Thus, when compressor 85 is running, the low temperature load 93 could be operating to the low end of this temperature tolerance, thus freezing the PCM. When the compressor 85 is turned off, the coolant 3 could still be expanded through the expansion valve 95. However, as this occurs the pressure in the low temperature loop will rise, increasing the operating temperature. However, once the temperature exceeds the melt temperature of the PCM in the PCM/Ev/Cnd 90, a significant amount of heat can be absorbed by the PCM; and thus, limit the temperature of the vapor in the low temperature loop until most or all of the phase change material melts. This absorption of heat would condense the vapor to liquid, which is significantly more dense than the vapor. This would enable the use of a smaller accumulator 83.

Still referring to FIG. 5B, under standby conditions when compressor 85 is operational and compressors 60*a*, 60*b* are not operational, valve 99*b* would be open while valves 99*c* and 99*d* would be closed in order to use the large condenser area available in the primary VCS 50*a* and thereby reduce compressor pressure ratio requirements. Under high load conditions, when compressors 60*a* and possibly 60*b* are operational, as well as compressor 85, valve 99*b* would be closed, while vales 99*c* and 99*d* are open. In this case, the third compressor 85 sends coolant to the vapor/liquid receiver 15. Under a high load condition, multiple compressors 60*a*, 60*b* are used to manage cooling capacity. If the heat load is reduced to relatively low, one of the compressors (60*a* or 60*b*) may be turned off in order to operate closer to peak efficiency and to reduce system power requirements.

In this concept, all compressors 60*a*, 60*b*, 85 could be driven by battery supplied power so that the compressors can quickly be ramped up to produce cooling while waiting for the prime mover generator power supply to come on-line. This will minimize the amount of PCM required. Also, multiple primary compressors 60*a*, 60*b* are implemented in order to reduce power requirements for the compressor(s) when the heat load to be cooled is much less than the maximum cooling capacity of the system.

Figure 6:
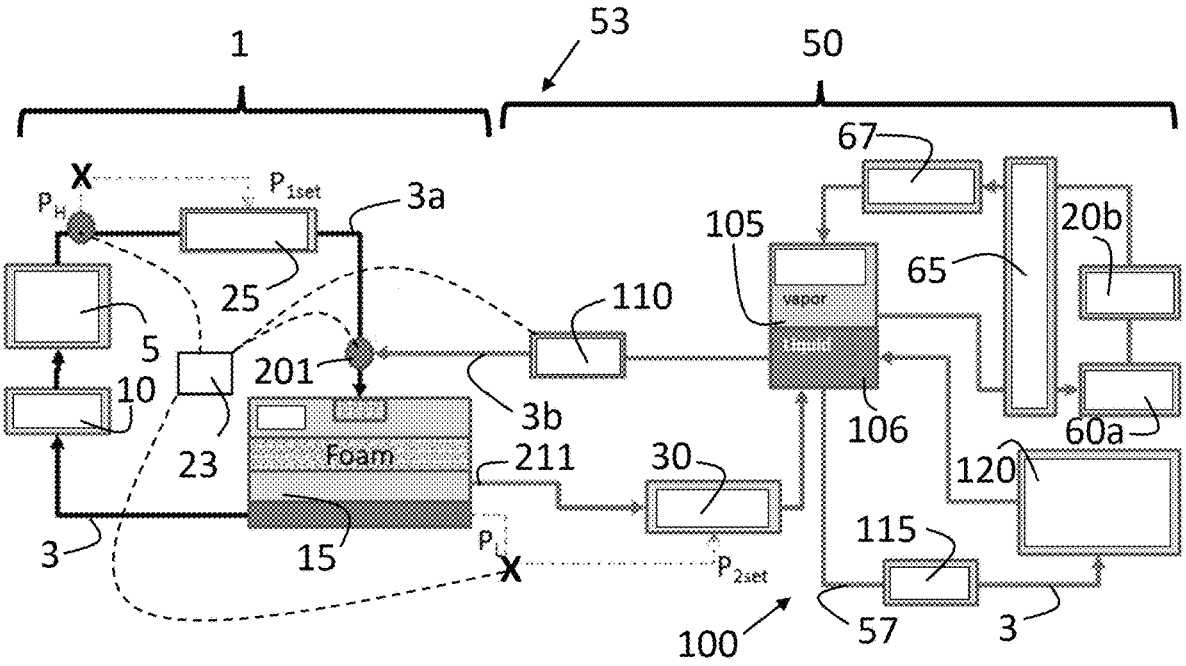
FIG. 6 is yet another schematic representation of a thermal management system configured to utilize the same coolant according to the teachings of the present disclosure.

Referring now to FIG. 6, another means to provide cooling of the TPPL 1 during start-up conditions would be to use a chilled coolant 3. If using chilled coolant 3, one could utilize the latent heat of the coolant 3. Using latent heat would reduce how cold the coolant 3 must be cooled in order for it to function as TES (i.e. the coolant would not need to be chilled to a very low temperature) This would enable a lower pressure ratio on the VCS compressor and therefore enable more efficient cooling of the coolant. However, when the liquid coolant 3 is vaporized, there is a very large increase in the volume of the vapor, relative to the liquid state of the coolant 3. In a space-constrained design, this may not be practical to accommodate.

An alternative would be to chill the coolant 3 to a temperature that is colder than the required steady state operating temperature of the coolant 3 and to also include more of the coolant 3 in liquid form than is necessary for steady state operation of the VCS 50*a*. In this way, the heat energy would be absorbed in the liquid coolant 3 and the temperature of the large quantity of liquid coolant 3 would rise very slowly. Therefore, the vapor pressure in the tank would rise much more slowly. This is expected to provide a smaller tank for the liquid coolant 3.

In using this approach, the amount of coolant 3 in the VCS 50*a* would need to be larger than the amount required to support steady state operation. This additional mass would make it more difficult to perform the initial chill down of the VCS 50*a*, because of the large amount thermal energy that must be removed from the coolant 3. Therefore, it may be necessary to sequester the additional coolant that is needed for TES into a separate tank. This would allow the VCS 50*a* and TPPL 1 to more quickly chill down to the required operating temperatures. Once the steady state operating condition is reached, the VCS 50*a* could continue with the chilling of the sequestered coolant to the operating temperature and then to continue chilling the full coolant charge to a temperature necessary to provide sufficient thermal storage capacity. For example, the portion of the coolant that is not in the segmented region (Volume 1) may be first cooled and used in support of steady-state operation of the VCS, while the sequestered portion of the coolant (Volume 2) is subsequently cooled after Volume 1, and then the coolant is further chilled to a lower temperature to provide thermal energy storage for later use in the VCS. This quantity of TES may be related to the amount of storage necessary to support the operation of the TPPL 1 before the VCS system 50*a* is able to reach full cooling capacity. To prolong the duration of the chilled fluid, the system should be thermally insulated to prevent heat from entering the TES and increasing its temperature.

Still referring to FIG. 6, an additional example of a thermal management system 53 is provided for dissipating a thermal load during operation of an apparatus. This thermal management system 53 comprises a two-phase pump loop (TPPL) 1 and a vapor cycle system (VCS) 50 configured to use the same coolant (FIG. 6). As shown in FIG. 4, a temperature difference must exist in the heat exchanger or condenser 20*a* in order to drive heat from the hotter fluid 3 to the colder fluid in the VSC. As shown in FIG. 6, the TPPL 1 in the thermal management system 53 is configured to cool the thermal load with tight control of the temperature of the coolant 3 that is cooling the apparatus. The TPPL 1 generally, includes a coolant 3, a vapor/liquid receiver 15, a pump 10, an evaporator 5, and a valve ($V_1$) 25 as previously described above and further defined herein.

Referring again to FIG. 6 an alternative concept is presented wherein the TPPL 1 and VCS 50 utilize the same coolant 3. In this case, the vapor from the TPPL 1 is condensed with the chilled coolant 3*b* that is injected into the 2-phase stream 3*a* of the TPPL 1 at a predetermined location 201, which represents a nozzle. The colder coolant 3*b* will absorb heat from the vapor, resulting in the vapor condensing. The VCS 50 is configured to operate at a temperature that is equal to or lower than the temperature of the evaporator in the TPPL.

The VCS 50 generally comprises: a low pressure receiver (LPR) 105 configured to store the coolant 3; a condenser 20*b* configured to release heat ($Q_{REJECTED}$) in order to remove the heat ($Q_{REJECTED}$) from the thermal management system 53 and to cool the coolant 3*b* below the temperature of coolant 3*a*; a pump 110 configured to force the cooled liquid coolant 3*b* to flow from the LPR 105 of the VCS 50 to the flow of coolant 3*a* that is downstream of evaporator 5 of the TPPL 1; a recuperator 65 configured to prevent the coolant 3 in liquid form from entering the compressor 60*a*; an expansion valve 67 configured to control the exit pressure of the compressor 60*a* and to reduce the coolant's pressure in order to lower the coolant's temperature; and a variable speed pump, or a variable area nozzle, or both to control the injection flow rate of cold coolant in order to keep the vapor/liquid receiver pressure nominally at $P_L$ and to replenish coolant mass in the vapor/liquid receiver; a valve ($V_2$) having a control set point set at a second pressure ($P_{2set}$) to prevent the vapor/liquid receiver having a pressure that is higher than a predetermined pressure/temperature limit ($P_L$) while also enabling a pressure greater than or equal to the pressure in the LPR; and a controller configured to control the set points of $V_1$ and $V_2$; wherein the controller is configured to set $P_{1set}$ so as to provide a predetermined temperature at the outlet of the evaporator and the controller is configured to vary $P_{2set}$ so as to maintain the pressure in the vapor/liquid receiver at $P_L$.

The valve ($V_2$) 30, in concert with the mass injection (as described below), seeks to keep the pressure in the vapor/liquid receiver 15 at $P_L$. The valve ($V_2$) 30 maintains this pressure, by restricting flow to the low pressure receiver (LPR) in the VCS 50. If the pressure drops below $P_L$, the valve ($V_2$) 30 closes. Dropping below this pressure may happen if the cold coolant is injected too quickly. However, the valve ($V_2$) 30 is generally open and will pass vapor there through when the pressure in the LPR goes above $P_L$.

The cooled liquid coolant 3*b* from the VCS 50 is injected into and combined with the two phase flow of coolant 3 in the TPPL 1 to aid in the condensation of the vapor portion of the coolant 3*a* that is present in the two-phase flow 3. In addition, a valve 30 may be located at the outlet of the vapor/liquid receiver 15 to prevent the pressure rising above a predetermined pressure limit set for the TPPL 1.

When desired, the vapor/liquid receiver 15 of the TPPL 1 further comprises a foam or porous structure configured to assist in condensing the coolant 3 from a vapor to a liquid. The VCS 50 may also comprise a second pump 115 configured to remove a portion of the coolant 3 from the LPR 105, to flow said portion of the coolant 3 to a secondary thermal load 120 in order to absorb heat therefrom, and to return the heated portion of the coolant 3 to the LPR 105. In addition, the LPR 105 may further comprise a segmented region 106 wherein a portion of the coolant 3 that provides thermal energy storage is sequestered.

Still referring to FIG. 6, in order for this concept to work, it is important to get good mixing of the 2-phase flow 3*a* in the TPPL 1 and the cold injected coolant 3*b*. One or all of the following options could be used. First, the cold coolant 3*b* could be injected directly into the two-phase stream 3*a*. The cold coolant 3*b* may be pressurized by the pump 110 and then injected into the two-phase stream 3*a*. The goal is to create fine droplets in order to increase the droplet surface area/volume ratio to improve vapor condensation. Second, the two-phase mixture (vapor and subcooled liquid) could encounter a foam or porous barrier. This foam or porous barrier could be made from foam metal, sintered beads, strips of material, or the like. The goal is that the subcooled coolant 3*b* would spread out on the large surface area of the foam, in order to improve the heat transfer from the vapor to the subcooled liquid. Finally, any subcooled liquid drops could then fall into a second foam layer in the vapor/liquid receiver 15. In this case, the desire would be that any vapor contained in the vapor/liquid receiver 15 could infiltrate the foam that is coated with subcooled liquid and therefore condense the vapor onto the subcooled liquid/foam surface.

A benefit of the concept shown in FIG. 6 is that no heat exchanger is needed for condensing the vapor. Second, the subcooled liquid will reach the temperature of the vapor, and hence the full TES capability of the cold coolant will be utilized. The full utilization of the TES will require less chilled coolant (smaller LPR) or not require that the coolant to be cooled to as low of temperature (allows a lower compressor pressure ratio) or the ability to reduce the time it takes to chill the coolant in the LPR.

In order to manage the temperature in the vapor/liquid receiver 15, the second valve ($V_2$) 30 is used that will pass vapor back to the LPR 105. The second valve $V_2$ 30 will prevent the LPR 105 from reaching too high of pressure and thus too high of temperature. This second valve ($V_2$) 30 may also keep the pressure greater than (or equal to) the pressure in the LPR 105. The $V_2$ 30 is intended to maintain pressure in the receiver at $P_L$. The $V_2$ 30 may be opened to keep the pressure from getting too high. If the pressure goes below $P_L$, then $V_2$ 30 will close in order to allow the LPR 105 to repressurize.

Over extended periods of time, the amount of vapor to be removed from the vapor/liquid receiver 15 is equal to the amount of mass injected. The rate of injection will be a function of at least $Q_{ABSORBED}$ and the temperature of the injected stream 3*b*. The amount of cold coolant to be injected may be controlled by the speed of the pump 110 or the amount that nozzle 201 is opened. The speed or nozzle area may be controlled with the controller 23 as shown in FIG. 6.

A further description of various structures, elements, and the performance associated with a TPPL and/or VCS is provided in a co-pending application entitled "Thermal Management System Including Two-Phased Pump Loop and Thermal Energy Storage" filed herewith that claims priority to U.S. Provisional Application No. 62/656,518 filed Apr. 12, 2018, the entire contents of which are hereby incorporated by reference.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The subject-matter of the disclosure may also relate, among others, to the following Aspects:

1. A two-phase pump loop (TPPL) for dissipating a thermal load during operation of an apparatus; the TPPL comprising:

a vapor/liquid receiver configured to store a coolant;

a pump configured to force the coolant to flow through the TPPL;

an evaporator configured to absorb heat ($Q_{ABSORBED}$) from the apparatus, the evaporator having an inlet and an outlet;

a condenser configured to release heat ($Q_{REJETED}$) in order to remove the heat ($Q_{REJECTED}$) from the TPPL;

a valve ($V_1$) configured to regulate a pressure or temperature of the coolant exiting the evaporator; the $V_1$ having a control set point set at a first pressure ($P_{1set}$) to achieve an evaporator exit pressure that is a saturation pressure ($P_H$) for the coolant at a predetermined exit temperature from the evaporator;

a valve ($V_2$) having a control set point set at a second pressure ($P_{2set}$) to prevent the vapor/liquid receiver pressure from going to a pressure/temperature that is lower than a predetermined value ($P_L$); and a controller configured to control the set points of $V_1$ and $V_2$; wherein the controller is configured to set $P_{1set}$ so as to provide a predetermined temperature at the outlet of the evaporator and the controller is configured to vary $P_{2set}$ so as to maintain the pressure in the vapor/liquid receiver at or above $P_L$;

wherein the TPPL is configured to cool the thermal load with tight control of the temperature of the coolant that is cooling the apparatus.

2. The two-phase pump loop (TPPL) according to Aspect 1, wherein the control set point of $V_2$ is varied to balance the heat ($Q_{REJECTED}$) removed from the condenser with the heat ($Q_{ABSORBED}$) absorbed at the evaporator along with any other heat additions or losses encountered.

3. The two-phase pump loop (TPPL) according to any of Aspects 1-2, wherein the TPPL further comprises;

a liquid return valve; and a liquid separator in fluid communication with the outlet of the evaporator; the liquid separator configured to return a substantial portion of the liquid portion of the coolant through the liquid return valve to the vapor/liquid receiver.

4. The two-phase pump loop (TPPL) according to Aspect 3, wherein the TPPL further comprises a sensor configured to measure the level of liquid in the liquid separator in order to control the flow through the liquid return valve.

5. The two-phase pump loop (TPPL) according to any of Aspects 1-4, wherein the TPPL is integrated with a vapor cycle system (VCS); the VCS is configured to remove heat from the TPPL when the temperature of the coolant flowing through the inlet of the evaporator is about ambient temperature or less than ambient temperature.

6. The two-phase pump loop (TPPL) according to Aspect 5, wherein the $V_1$ and $V_2$ are independently selected to be an expansion valve, a pressure reducing valve, or a back pressure regulator.

7. A thermal management system for dissipating a thermal load during operation of an apparatus; the thermal management system comprising a two-phase pump loop (TPPL) and a primary vapor cycle system (p-VCS) that are configured to use the same coolant and to be in fluid communication through a vapor/liquid receiver;

wherein the TPPL comprises:

the vapor/liquid receiver configured to store the coolant;

a pump configured to force the coolant to flow throughout the TPPL;

an evaporator configured to absorb heat ($Q_{ABSORBED}$) from the apparatus, the evaporator having an inlet and an outlet;

a valve ($V_1$) having a control set point set at a first pressure ($P_{1set}$) measured downstream of the evaporator, the $P_{1set}$ set to achieve an evaporator exit pressure that is the saturation pressure ($P_H$) of the coolant at a predetermined target exit temperature from the evaporator;

a valve ($V_2$) having a control set point set at a second pressure ($P_{2set}$) to prevent the vapor/liquid receiver pressure from going to a pressure/temperature that is lower than a predetermined value ($P_L$); and a controller configured to control the set points of $V_1$ and $V_2$; wherein the controller is configured to set $P_{1set}$ so as to provide a predetermined temperature at the outlet of the evaporator and the controller is configured to vary $P_{2set}$ so as to maintain the pressure in the vapor/liquid receiver at or above $P_L$;

wherein the p-VCS comprises:

the vapor/liquid receiver configured to store the coolant;

a condenser configured so that the coolant releases heat ($Q_{REJECTED}$) in order to remove heat ($Q_{REJECTED}$) from the thermal management system;

a first compressor;

a valve ($V_3$) configured to act as an expansion valve; the $V_3$ having a control set point set to maintain a predetermined pressure at an outlet of the compressor; and one or more recuperators configured with a condenser exit flow or hot gas bypass flow to prevent any coolant in liquid form from entering the compressor;

wherein $V_2$ is configured to allow a portion of the coolant exiting the compressor to flow back into the vapor/liquid receiver in order to prevent overcooling of the vapor/liquid receiver while allowing the compressor to continue to run.

8. The thermal management system according to Aspect 7, wherein the control set points of $V_2$ and $V_3$ are variable in order to balance the heat ($Q_{REJECTED}$) removed from the condenser with the heat ($Q_{ABSORBED}$) absorbed at the evaporator along with any other heat additions or losses encountered.

9. The thermal management system according to any of Aspects 7 or 8, wherein the p-VCS comprises a second compressor located parallel to the compressor in order to minimize power draw.

10. The thermal management system according to any of Aspects 7-9, wherein the $V_1$, $V_2$, and $V_3$ are independently selected to be an expansion valve, a pressure reducing valve, or a back pressure regulator.

11. The thermal management system according to Aspect 9, wherein the thermal management system further comprises a secondary vapor cycle system (s-VCS) configured to operate at a lower temperature than the p-VCS and is able to operate at a smaller thermal load or to operate when the p-VSC is not operational;

wherein the s-VCS comprises:

a phase change material (PCM) located in an evaporator/condenser (PCM/Ev/Cnd), the PCM providing thermal energy storage by absorbing heat until the p-VCS, the s-VCS, or both the p-VCS and s-VCS are operational;

an accumulator;

an expansion valve;

a third compressor configured to force a the coolant to flow to the vapor/liquid receiver or to the condenser;

a controller configured to control the expansion valve such that only vapor enters the third compressor; and a plurality of valves configured to allow the s-VCS to use the condenser located in the p-VCS when the p-VCS is turned off or to allow the coolant to flow to the vapor/liquid receiver when the p-VCS is operational.

12. The thermal management system according to Aspect 11, wherein one or more of the compressors are run using a battery power source.

13. A thermal management system for dissipating a thermal load during operation of an apparatus; the thermal management system comprising a two-phase pump loop (TPPL) and a vapor cycle system (VCS) configured to use the same coolant;

the TPPL comprising:

a vapor/liquid receiver configured to store a coolant;

a pump configured to force the coolant to flow throughout the TPPL; the flow of coolant being a flow of a liquid or a two-phase flow that includes a vapor and a liquid;

an evaporator configured to absorb heat ($Q_{ABSORBED}$) from the apparatus, the evaporator comprising an inlet and an outlet;

a valve ($V_1$) configured to regulate a pressure at or after an outlet of the evaporator, the $V_1$ having a control set point set at a first pressure ($P_{1set}$) to achieve an evaporator exit pressure that is the saturation pressure ($P_H$) of the coolant at a predetermined exit temperature from the evaporator; and wherein the TPPL is configured to cool the thermal load with tight control of the temperature of the coolant that is cooling the apparatus.

14. The thermal management system according to Aspect 13, wherein the VCS is configured to operate at a temperature equal to or lower than the temperature of the evaporator in the TPPL.

15. The thermal management system according to any of Aspects 13 or 14, wherein the VCS comprises:

a low pressure receiver (LPR) configured to store the coolant;

a condenser configured to release heat ($Q_{REJECTED}$) in order to remove the heat ($Q_{REJECTED}$) from the thermal management system and to cool the coolant;

a compressor to force the coolant in vapor form to the condenser;

a valve ($V_2$) having a control set point set at a second pressure ($P_{2set}$) to prevent the vapor/liquid receiver having a pressure that is higher than a predetermined pressure/temperature limit ($P_L$) while also enabling a pressure greater than or equal to the pressure in the LPR;

a controller configured to control the set points of $V_1$ and $V_2$; wherein the controller is configured to set $P_{1set}$ so as to provide a predetermined temperature at the outlet of the evaporator and the controller is configured to vary $P_{2set}$ so as to maintain the pressure in the vapor/liquid receiver at $P_L$;

a recuperator configured to prevent the coolant in liquid form from entering the compressor;

an expansion valve configured to control the exit pressure of the compressor and to reduce the coolant's pressure in order to lower the coolant's temperature; a pump configured to force the cooled liquid coolant to flow from the LPR of the VCS to the coolant lines exiting the evaporator of the TPPL; wherein the cooled liquid coolant from the VCS is injected into and combined with the two-phase flow of coolant in the TPPL to aid in the condensation of the coolant in vapor form that is present in the two-phase flow; and a variable speed pump, or a variable area nozzle, or both to control the injection flow rate of cold coolant in order to keep the vapor/liquid receiver pressure nominally at $P_L$ and to replenish coolant mass in the vapor/liquid receiver.

16. The thermal management system according to Aspect 15, wherein the $V_1$ and $V_2$ are independently selected to be an expansion valve or a back pressure regulator.

17. The thermal management system according to any of Aspects 13-16, wherein the vapor/liquid receiver further comprises a foam or porous structure configured to assist in condensing the coolant from a vapor to a liquid.

18. The thermal management system according to any of Aspects 16 or 17 wherein the VCS further comprises a second pump; the second pump configured to remove a portion of the coolant from the LPR, to flow said portion of the coolant near a secondary thermal load in order to absorb heat therefrom, and to return the heated portion of the coolant to the LPR.

19. The thermal management system according to any of Aspects 16-18, wherein the LPR further comprises a segmented region wherein a portion of the coolant is sequestered.

20. The thermal management system according to Aspect 19, wherein the portion of the coolant that is not in the segmented region (Volume 1) is first cooled and used in support of steady-state operation of the VCS, while the sequestered portion of the coolant (Volume 2) is subsequently cooled after Volume 1, and optionally, the coolant is then further chilled to a lower temperature to provide thermal energy storage for later use in the VCS.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A two-phase pump loop (TPPL) for dissipating a thermal load during operation of an apparatus; the TPPL comprising:

a vapor/liquid receiver configured to store a coolant;

a pump configured to force the coolant to flow through the TPPL;

an evaporator configured to absorb heat ($Q_{ABSORBED}$) from the apparatus, the evaporator having an inlet and an outlet;

a condenser configured to release heat ($Q_{REJECTED}$) in order to remove the heat ($Q_{REJECTED}$) from the TPPL;

a valve ($V_1$) configured to regulate a pressure or temperature of the coolant exiting the evaporator; the $V_1$ having a control set point set at a first pressure ($P_{1set}$) to achieve an evaporator exit pressure that is a saturation pressure ($P_H$) for the coolant at a predetermined exit temperature from the evaporator;

a valve ($V_2$) having a control set point set at a second pressure ($P_{2set}$) to prevent the vapor/liquid receiver pressure from going to a pressure/temperature that is lower than a predetermined value ($P_L$);

a controller configured to control the set points of $V_1$ and $V_2$; wherein the controller is configured to set $P_{1set}$ so as to provide a predetermined temperature at the outlet of the evaporator and the controller is configured to vary $P_{2set}$ so as to maintain the pressure in the vapor/liquid receiver at or above $P_L$;

a liquid return valve; and a liquid separator in fluid communication with the outlet of the evaporator, the liquid separator configured to return a substantial portion of the liquid portion of the coolant through the liquid return valve to the vapor/liquid receiver, wherein the TPPL is configured to dissipate the thermal load with tight control of the temperature of the coolant that is cooling the apparatus.

2. The two-phase pump loop (TPPL) according to claim 1, wherein the control set point of $V_2$ is varied to balance the heat ($Q_{REJECTED}$) removed from the condenser with the heat ($Q_{ABSORBED}$) absorbed at the evaporator along with any other heat additions or losses encountered.

3. The two-phase pump loop (TPPL) according to claim 1, wherein the TPPL further comprises a sensor configured to measure the level of liquid in the liquid separator in order to control the flow through the liquid return valve.

4. The two-phase pump loop (TPPL) according to a claim 1, wherein the TPPL is integrated with a vapor cycle system (VCS); the VCS is configured to remove heat from the TPPL when the temperature of the coolant flowing through the inlet of the evaporator is about ambient temperature or less than ambient temperature.

5. The two-phase pump loop (TPPL) according to claim 4, wherein the $V_1$ and $V_2$ are independently selected to be an expansion valve, a pressure reducing valve, or a back pressure regulator.

* * * * *